US006356184B1

(12) United States Patent
Doi et al.

(10) Patent No.: US 6,356,184 B1
(45) **Date of Patent: *Mar. 12, 2002**

(54) RESISTOR CHIP

(75) Inventors: Masato Doi; Susumu Okuno, both of Kyoto (JP)

(73) Assignee: Rohm Co., Ltd., Kyota (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/433,388

(22) Filed: Nov. 3, 1999

(30) Foreign Application Priority Data

Nov. 27, 1998 (JP) ..... 10-337497

(51) Int. Cl.[7] ..... H01C 1/012

(52) U.S. Cl. ..... 338/309; 338/313; 338/314; 338/328; 338/332

(58) Field of Search ..... 338/306, 307, 338/308, 309, 313, 314, 328, 332

(56) References Cited

U.S. PATENT DOCUMENTS 4,529,960 A * 7/1985 Uchida et al. ..... 338/309
4,780,702 A * 10/1988 Snel et al. ..... 338/308
4,792,781 A * 12/1988 Takahashi et al. ..... 338/307
5,258,738 A * 11/1993 Schat ..... 338/332
5,379,016 A * 1/1995 Smith et al. ..... 338/308
5,379,017 A * 1/1995 Katsuno ..... 338/332
5,691,690 A * 11/1997 Minato et al. ..... 338/309
5,907,274 A * 5/1999 Kimura et al. ..... 338/309
5,966,067 A * 10/1999 Murakami et al. ..... 338/309
5,990,781 A * 11/1999 Kambara ..... 338/309
5,994,996 A * 11/1999 Van Den Broek et al. .. 338/309

* cited by examiner

*Primary Examiner*—Karl D. Easthom
(74) *Attorney, Agent, or Firm*—Beyer Weaver & Thomas LLP

(57) ABSTRACT

A resistor chip has a pair of mutually separated upper-surface electrodes on the upper surface of an electrically insulating substrate in a form of a chip, an resistor film having end portions which are each over a corresponding one of these upper-surface electrodes, a cover coating made of a glass material which is over a portion of this resistor film, and a pair of plated metallic layers each over a corresponding one of end surfaces of the substrate. Edge sections of the insulator film over the upper-surface electrodes are not covered by the cover coating and are each directly covered by one of these plated metallic layers.

10 Claims, 1 Drawing Sheet

RESISTOR CHIP

BACKGROUND OF THE INVENTION

This invention relates to a resistor chip structured by forming not only an electrically resistant layer on the surface of an electrically insulating substrate in the form of a chip but also terminal electrodes on both end parts of this substrate.

Prior art resistor chips of this type were usually produced firstly by forming an electrical resistor film on the upper surface of an insulating substrate, upper-surface electrodes of a silver material on both end parts and a glass cover coating so as to entirely cover the resistant layer. Next, side-surface silver electrodes are formed on the side surfaces of the substrate so as to be electrically connected to these upper-surface electrodes, and a plated metallic layer comprising a nickel layer serving as a lower layer and a tin or solder layer serving as an upper layer is formed on each of the upper-surface and side-surface electrodes.

With a prior art resistor chip thus structured, because the surfaces of its silver upper electrodes are covered in part by a glass cover coating and in part by a plated metallic layer, a force comes to be concentrated along the boundaries between the cover coating and the plated metallic layer on the upper electrodes due to the difference between their coefficients of thermal expansion. Thus, cracks tend to be easily formed along these boundary portions, not only causing the resistance of the resistor to vary but also separating the upper electrodes with the resistor film.

In view of such problems, Japanese Patent Publication Tokkai 4-237102 proposed extending both end parts of the resistor film beyond the cover coating on the upper side of the upper-surface electrodes and forming a plated metallic layer also on the surface of the extended portions. According to the disclosure therein, however, the width of the resistor film is made smaller than that of the upper-surface electrodes. Thus, the outer portions of the upper-surface electrodes are not covered by the extended portion of the resistor film, and boundaries between the glass cover coating and the plated metallic layers on the upper-surface electrodes were in part on the surface of these parts.

As a result, probability remained to exist for the occurrence of cracks in the portions of the upper-surface electrodes outside the extended parts of the resistor film due to the aforementioned difference in the coefficient of thermal expansion. Such cracks are likely to extend even to the portions covered by the resistor film. Moreover, gaps are likely to result between the plated metallic layers and the cover coating on the outer portions of the upper-surface electrodes beyond the extended parts of the resistor film due the difference between their coefficients of thermal expansion. When the resistor chip is used in an atmosphere of a corrosive gas, the upper-surface electrodes at such gaps become corroded by such a gas. If the corrosion extends to the area covered by the extended parts of the resistor film, this certainly will affect the resistance value of the resistor chip.

SUMMARY OF THE INVENTION

It is therefore an object of this invention in view of the problems described above to provide a resistor chip of an improved structure.

A resistor chip embodying this invention, with which the above and other objects can be accomplished, may be characterized not only as comprising an electrically insulating substrate in the form of a chip, a pair of upper-surface electrodes on the upper surface of the substrate and mutually separated from each other, an resistor film having end portions which are each over a corresponding one of these upper-surface electrodes, a cover coating made of a glass material which is over a portion of the resistor film, and a pair of plated metallic layers each over an end surface of the substrate but also wherein edge sections of the resistor film over the upper-surface electrodes are not covered by the cover coating and are each directly covered by one of the plated metallic layers. The upper-surface electrodes and the end portions of the resistor film may be rectangular, for example, with the width of the upper-surface electrodes made smaller than the width of the end portions of the resistor film.

With a resistor chip thus structured, with the portions of the upper-surface electrodes abutting the cover coating completely covered by the widened end portions of the resistor film such that the forces caused by the difference between the coefficients of thermal expansion of the upper-surface electrodes and the glass cover coating can be dispersed over the end portions of the resistor film. Thus, the upper-electrodes can be dependably prevented from becoming corroded even if the resistor chip is used in an atmosphere of a corrosive gas and a gap is generated between the plated metallic layers and the cover coating because the upper-electrodes will not be exposed through such a gap. As a result, the present invention can provide highly reliable resistor chip with no changes in the resistance value.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
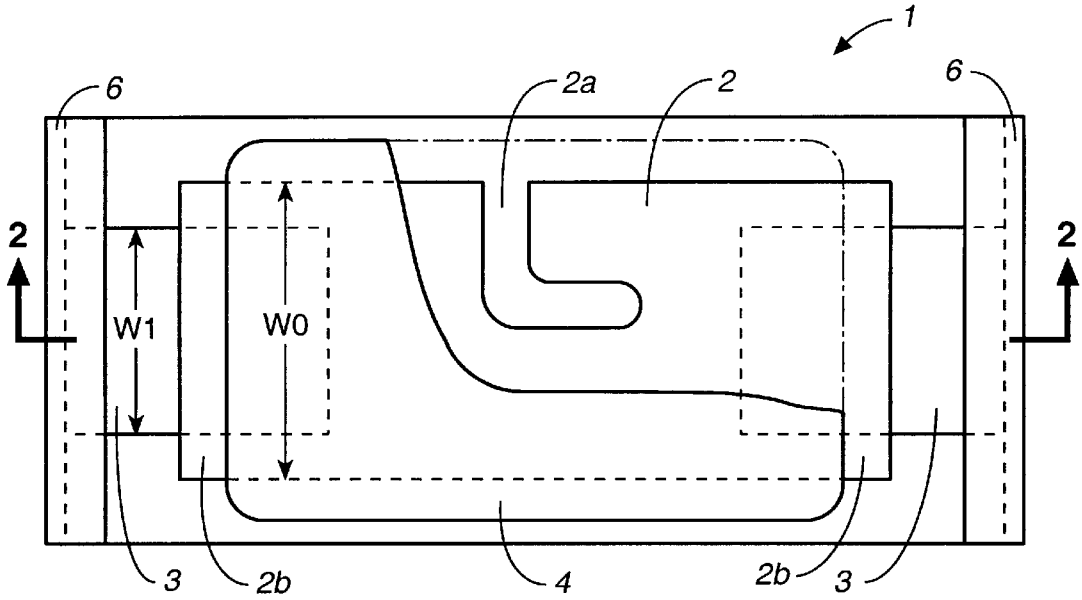
FIG. 1 is a plan view of a resistor chip embodying this invention with some components partially removed.

The invention is described next by way of an example with reference to FIGS. 1 and 2 wherein numeral 1 indicates an electrically insulating substrate in the form of a chip. Formed on the upper surface of this substrate 1 are a film of an electrically resistant material ("a resistor film") 2 so as not to directly contact the upper-surface electrodes 3, a pair of upper-surface electrodes 3 each contacting a different end part of the resistor film 2, and a glass cover coating 4 which covers the resistor film 2. A pair of lower-surface electrodes 5 is formed at end portions of the lower surface of the substrate 1. Formed on each of the mutually oppositely facing end surfaces of the substrate 1 is an end-surface electrode 6 which electrically connects associated ones of the upper-surface electrodes 3 and the lower-surface electrodes 5. A plated metallic layer 7, consisting of a plated nickel layer serving as a lower layer and a plated tin or solder layer serving as an upper layer, is further formed on each of the end-surface electrodes 6 as well as on and directly contacting the associated ones of the upper-surface electrodes 3 and the lower-surface electrodes 5. As shown in FIG. 2, the resistor film 2 has a notch 2*a* for adjusting the resistance value of the chip such that it will be within its specified allowable range.

Figure 2:
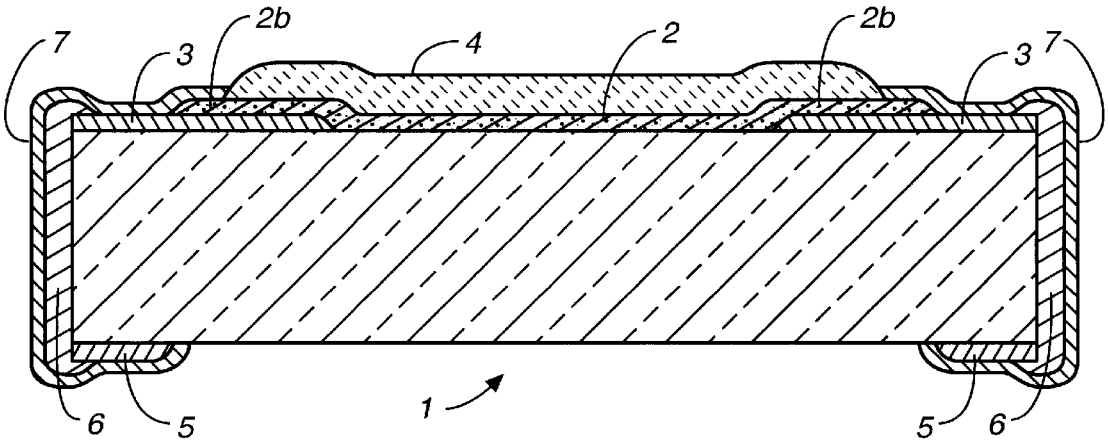
FIG. 2 is a sectional view of the resistor chip of FIG. 1 taken along line 2—2 therein.

As shown in FIG. 1, the width $W_0$ of the resistor film 2 is greater than the width $W_1$ of the upper-surface electrodes 3, the widths being measured perpendicularly to the direction in which the end-surface electrodes 6 face each other. Moreover, as shown both in FIGS. 1 and 2, the resistor film 2 has extended portions 2*b* which are integrally formed and extend in both directions towards the end-surface electrodes 6 over and directly contacting the upper-surface electrodes 3 and beyond the glass cover coating 4. The plated metallic layers 7 formed over the end-surface electrodes 6 are also extended so as to also cover the extended portions 2*b* of the resistor film 2.

With the layers thus formed, the portions of the upper-surface electrodes 3 that abut the glass cover coating 4 are completely covered by the wider extended portions 2*b* of the resistor film 2 than the upper-surface electrodes 3. As a result, any stress that may be caused by the difference between the coefficients of thermal expansion of the upper-surface electrodes 3 and the glass cover coating 4 will be dispersed over the extended portions 2*b* of the resistor film 2, and hence the cracking of the upper-surface electrodes 3 can be reliably prevented. Even if a gap may be caused between the plated metallic layers 7 and the cover coating 4, the upper-surface electrodes 3 will not become exposed to the exterior through such a gap because of the extended portions 2*b* of the resistor film 2. Thus, even if the resistor chip is used in an atmosphere of a corrosive gas, corrosion of the upper-surface electrodes 3 by such a corrosive gas can be prevented.

Although the invention was described above by way of only one example, this illustrated example is not intended to limit the scope of the invention. Many modifications and variations are possible within the scope of this invention. Although the resistor film 2 was described as having a generally rectangular shape (except for the notch 2*a*) with a uniform width $W_0$ which is greater than the width $W_1$ of the upper-surface electrodes 3, the resistor film 2 may be formed narrower throughout its length (in the direction along which the end-surface electrodes 6 face each other) except there the resistor film 2 overlaps the upper-surface electrodes 3. Such an embodiment will be preferable because the amount of the material used for the formation of the resistor film 2 can be thereby reduced. Moreover, the notch 2*a* can then be made shorter and hence the adjustment of the resistance value can be effected more quickly than if the resistor film 2 had a greater width throughout its length.

Described briefly, the resistor chip described above may be produced by forming the lower-surface electrodes 5 on the lower-surface of the substrate 1, thereafter forming the upper-surface electrodes 3 on the upper surface of the substrate 1, thereafter forming the resistor film 2 and trimming it to adjust the resistance value, forming the cover coating 4, thereafter forming the end-surface electrodes 6 and finally forming the plated metallic layers 7 by the barrel plating method.

What is claimed is:

1. A resistor chip comprising:

an electrically insulating substrate in a form of a chip having a pair of end surfaces which face mutually each other in a longitudinal direction and an upper surface which extends between said end surfaces;

a pair of upper-surface electrodes which are on said upper surface and are separated from each other in said longitudinal direction;

a resistor film having end portions which are each over and directly contacting a corresponding one of said upper-surface electrodes;

a cover coating over a portion of said resistor film, said cover coating not directly contacting said upper-surface electrodes;

a pair of end-surface electrodes each formed over a corresponding one of said end surfaces and contacting a corresponding one of said upper-surface electrodes; and a pair of plated metallic layers each over a corresponding one of said end-surface electrodes and directly contacting a portion of a corresponding one of said upper-surface electrodes;

wherein edge sections of said end portions of said resistor film over and directly contacting said upper-surface electrodes are not covered by said cover coating and are each directly contacted by a corresponding one of said plated metallic layers.

2. The resistor chip of claim 1 wherein said substrate also has a lower surface which is opposite from said upper surface and extends between said end surfaces; wherein said resistor chip further comprises a pair of lower-surface electrodes which are on said lower surface and are separated from each other in said longitudinal direction; wherein each of said plated metallic layers each directly contacts a corresponding one of said lower-surface electrode.

3. The resistor chip of claim 1 wherein said upper-surface electrodes and said end portions of said resistor film are rectangular, each having a width perpendicular to said longitudinal direction, and wherein the width of said upper-surface electrodes is smaller than the width of said end portions of said resistor film.

4. The resistor chip of claim 1 wherein said cover coating and said upper-surface electrodes have different coefficients of thermal expansion.

5. The resistor chip of claim 3 wherein said cover coating and said upper-surface electrodes have different coefficients of thermal expansion.

6. The resistor chip of claim 1 wherein said cover coating comprises a glass material.

7. The resistor chip of claim 3 wherein said cover coating comprises a glass material.

8. The resistor chip of claim 4 wherein said cover coating comprises a glass material.

9. The resistor chip of claim 5 wherein said cover coating comprises a glass material.

10. The resistor chip of claim 1 wherein each of said plated metallic layers directly contacts a corresponding one of said upper-surface electrodes.

* * * * *